US009191759B2

(12) United States Patent
Hillbratt et al.

(10) Patent No.: US 9,191,759 B2
(45) Date of Patent: Nov. 17, 2015

(54) DATA TRANSMISSION THROUGH A RECIPIENT'S SKULL BONE

(71) Applicant: Cochlear Limited, Macquarie University, NSW (AU)

(72) Inventors: Martin E. Hillbratt, Lindome (SE); Marcus Andersson, Gothenburg (SE)

(73) Assignee: Cochlear Limited, Macquarie University, NSW (AU)

( * ) Notice: Subject to any disclaimer, the term of this patent is extended or adjusted under 35 U.S.C. 154(b) by 55 days.

(21) Appl. No.: 13/835,235

(22) Filed: Mar. 15, 2013

(65) Prior Publication Data

US 2014/0275729 A1 Sep. 18, 2014

(51) Int. Cl.
*H04R 25/00* (2006.01)

(52) U.S. Cl.
CPC ..... *H04R 25/606* (2013.01); *H04R 25/552* (2013.01); *H04R 2225/55* (2013.01); *H04R 2460/13* (2013.01)

(58) Field of Classification Search
CPC .. H04R 25/00; H04R 1/1016; H04R 2460/13; H04R 2460/17
USPC ..... 381/326, 151, 380; 600/25; 607/55–57
See application file for complete search history.

(56) References Cited

U.S. PATENT DOCUMENTS

| | | | | |
|---|---|---|---|---|
| 4,759,070 | A * | 7/1988 | Voroba et al. | 381/328 |
| 6,084,975 | A * | 7/2000 | Perkins | 381/326 |
| 6,738,485 | B1 * | 5/2004 | Boesen | 381/326 |
| 7,043,040 | B2 * | 5/2006 | Westerkull | 381/326 |
| 8,433,080 | B2 * | 4/2013 | Rader et al. | 381/151 |

* cited by examiner

*Primary Examiner* — Suhan Ni
(74) *Attorney, Agent, or Firm* — Hauptman Ham, LLP

(57) ABSTRACT

Systems and methods are disclosed for data transmission through a recipient's skull bone. In one aspect of the present technology there is provided a bilateral system, comprising a first mechanical stimulator configured to transmit first data through vibrations of a skull of a recipient, and a sensor device configured to receive the first transmitted data.

31 Claims, 5 Drawing Sheets

DATA TRANSMISSION THROUGH A RECIPIENT'S SKULL BONE

BACKGROUND

1. Field of the Technology

The present technology relates generally to bilateral hearing prostheses, and more particularly to data transmission through a recipient's skull bone.

2. Related Art

Hearing loss, which may be due to many different causes, is generally of two types, conductive and sensorineural. Sensorineural hearing loss occurs when there is damage to the inner ear, or to the nerve pathways from the inner ear to the brain. Conductive hearing loss occurs when the normal mechanical pathways for sound to reach the cochlea are impeded, for example, by damage to the ossicles. Individuals suffering from conductive hearing loss typically have some form of residual hearing because the hair cells in the cochlea are undamaged. As a result, individuals suffering from conductive hearing loss typically receive a prosthetic hearing device that generates mechanical motion of the cochlea fluid. For example, acoustic energy may be delivered through a column of air to the tympanic membrane (eardrum) via a hearing aid residing in the ear canal. Mechanical energy may be delivered via the physical coupling of a mechanical transducer (i.e. a transducer that converts electrical signals to mechanical motion) to the tympanic membrane, the skull, the ossicular chain, the round or oval window of the cochlea or other structure that will result in the delivery of mechanical energy to the hydro-mechanical system of the cochlea.

Individuals suffering from conductive hearing loss typically receive an acoustic hearing aid, referred to as a hearing aid herein. Unfortunately, not all individuals who suffer from conductive hearing loss are able to derive suitable benefit from hearing aids. Furthermore, hearing aids are typically unsuitable for individuals who suffer from single-sided deafness (total hearing loss only in one ear). Hearing aids commonly referred to as "cross aids" have been developed for single sided deaf individuals. These devices receive the sound from the deaf side with one hearing aid and present this signal (either via a direct electrical connection or wirelessly) to a hearing aid which is worn on the contra lateral (or, in other words, the ipsi lateral or opposite) side of the recipient's head. Unfortunately, this requires the recipient to wear two hearing aids. Additionally, in order to prevent acoustic feedback problems, hearing aids generally require that the ear canal be plugged, resulting in unnecessary pressure, discomfort, or other problems such as eczema.

As noted, hearing aids rely primarily on the principles of air conduction. However, other types of devices commonly referred to as bone conducting hearing aids or bone conduction devices, function by converting a received sound into a mechanical force. This force is transferred through the bones of the skull to the cochlea and causes motion of the cochlea fluid. Hair cells inside the cochlea are responsive to this motion of the cochlea fluid and generate nerve impulses which result in the perception of the received sound. Bone conduction devices have been found suitable to treat a variety of types of hearing loss and may be suitable for individuals who cannot derive sufficient benefit from hearing aids, cochlear implants, etc., or for individuals who suffer from stuttering problems.

SUMMARY

In one aspect of the present technology there is provided a bilateral system, comprising: a first mechanical stimulator device configured to transmit first data through vibrations of a skull of a recipient and a sensor device configured to receive the first transmitted data through the vibrations of the skull.

In another aspect there is provided a method of transmitting data comprising: generating with a first device a vibration to be applied to a skull of a recipient and receiving with a second device the vibration, whereby the data is transmitted through the skull via the vibration.

In yet another aspect there is provided a device comprising: a transceiver configured to receive a first vibration transmitted through a skull of recipient, and to generate a second vibration transmitted through the skull of the recipient.

BRIEF DESCRIPTION OF THE DRAWINGS

Embodiments of the present technology are described below with reference to the attached drawings, in which.

DETAILED DESCRIPTION

Bone conduction devices function by converting received sounds into a mechanical force, which is transferred through the bones of the skull. Recipients have also been provided with two hearing prostheses, such as two bone conduction devices, each fitted for one of the two auditory systems of the recipient. Such combination of hearing prostheses is commonly referred to as a bilateral hearing prosthesis system, or bilateral prostheses. Bilateral prostheses are generally considered to provide a benefit to the recipient, in that bilateral sound percepts allow for better speech perception by the recipient. It is believed that one important effect is the compensation for the head shadow effect, essentially allowing the recipient to selectively listen to the side with the better signal-to-noise ratio, generally the side closer to the source of the sound.

The implantable components and associated external components used for bilateral systems are primarily designed to function as independent, monaural systems. It has been observed, however, that the independent operation of such hearing prostheses may be degraded when the hearing prostheses operate in close proximity to each other. Such degradation in operational performance may adversely affect the hearing benefit delivered to the recipient. Such degradation may also affect the quality and integrity of data supplied from the hearing prosthesis, such as telemetry data generated by the hearing prosthesis for clinical and diagnostic use by healthcare professionals.

Embodiments of the present technology are generally directed to a bilateral hearing prosthesis. More specifically, embodiments of the present technology are directed to one hearing device converting a received sound or other data signal into a mechanical force for delivery to a second hearing device through a recipient's skull. For example, embodiments of the present technology may be directed to a mechanical stimulator device converting a received sound signal into a mechanical force for delivery to a sensor device, which may include a second mechanical stimulator, through a recipient's skull. The devices may comprise a sound input element to receive sound signals and a vibrating transducer connected to the sound input element and configured to vibrate in response to signals received by the input sound element. A housing may be placed on each side of the recipient's head and each housing is configured to house one or more operational components of its corresponding device, such as, for example, the transducer. The transducer vibrates and generates mechanical force which is delivered to the skull of the recipient. Data (which may be audio or other types of data) is transmitted through the recipient's skull from one side of the head to the other, where the data is received and processed and used for synchronization and other functions, as will be described in further detail below.

Figure 1:
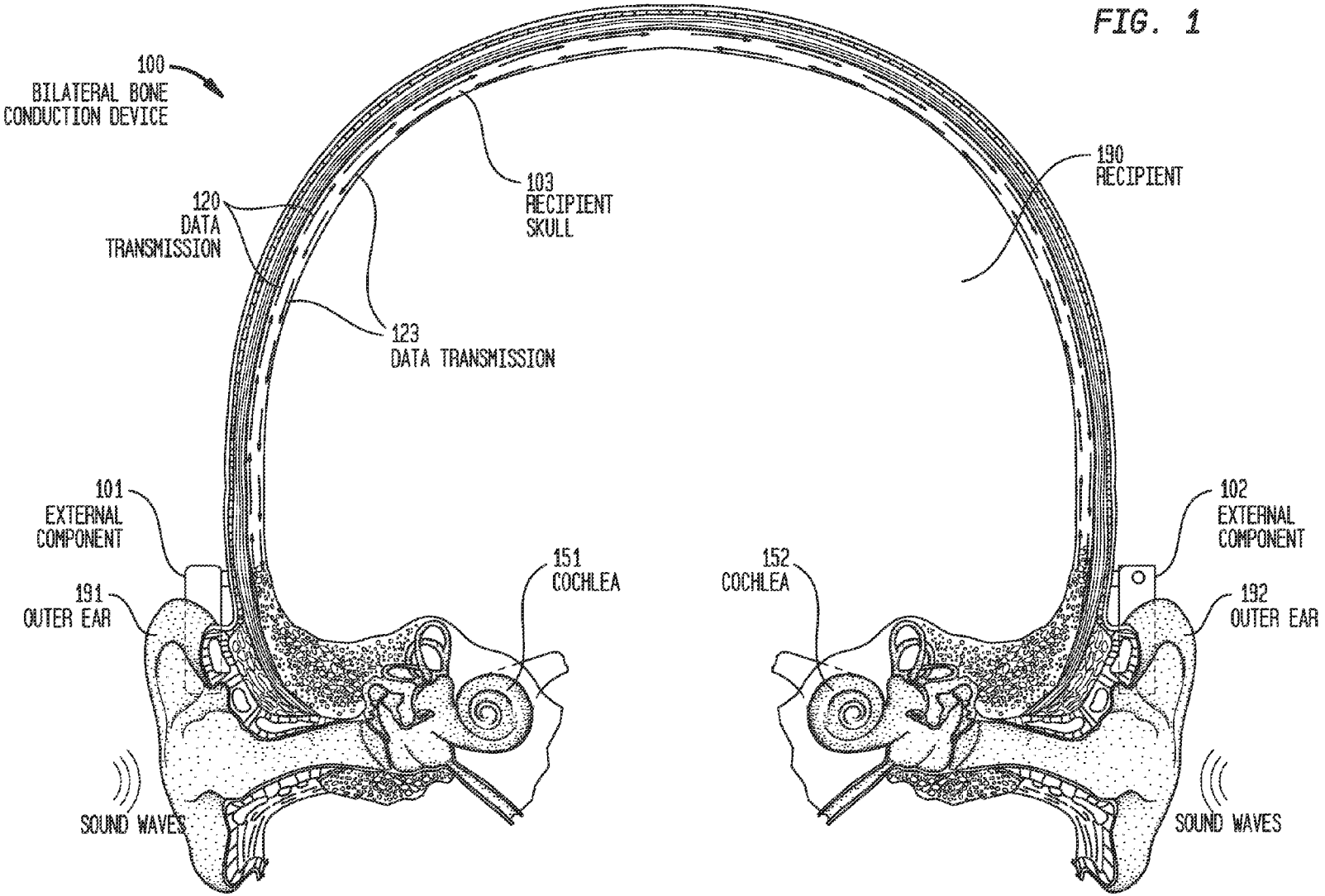
FIG. 1 illustrates a perspective view of a bilateral bone conduction hearing system in which embodiments of the present technology may be implemented.

FIG. 1 illustrates a perspective view of a bilateral bone conduction hearing system in which embodiments of the present technology may be implemented. More specifically, FIG. 1 shows bilateral hearing prosthesis 100 implemented on a recipient. Bilateral hearing prosthesis 100 includes first external component 101 and second external component 102. Bilateral hearing prosthesis 100 is designed to transmit data 120 between first external component 101 and second external component 102 and/or to transmit data 123 from second external component 102 to first external component 101. More specifically, bilateral hearing prosthesis 100 is designed to transmit between a first external component 101 and a second external component 102 via the recipient's skull 103, in which data transmission 120 and 123 may travel. It is appreciated by a person of ordinary skill in the art that the skull, as referenced herein, may include the cranium, but may also include other portions of the recipient's skull (e.g., the mandible). It should also be appreciated that skull as referenced herein, may also include teeth.

The recipient comprises ears 191 and 192, cochlea 151 and 152 and skull 103. First external component 101 may be positioned behind or hooked on outer ear 191 of the recipient and second external component 102 may be positioned behind or hooked on outer ear 192 of the recipient. However, external components 101 and 102 may be placed anywhere on the recipient such that external components 101 and 102 are located adjacent to skull 103. Embodiments of the present technology are described and shown in FIGS. 1 and 2 where external components 101 and 102 include percutaneous bone conduction devices. However, embodiments of the present technology may also be implemented using behind-the-ear (BTE) devices, middle ear implants, or any other device that uses vibration to transmit sound and/or data. The size of the external components 101 and 102 can vary depending on the mounting position on a recipient's skull, teeth, etc.

First external component 101 is designed to transmit data into the recipient, and may transmit data to cochlea 151 and/or to external component 102. Second external component 102 is designed to transmit data into the recipient, and may transmit data to cochlea 152 and/or to external component 101. In other applications, sound or data transmitted from external component 101 to external component 102 or from external component 102 to external component 101 may be treated as noise or unwanted feedback and canceled out using filters or feedback algorithms. However, on the other hand, data transmitted between external component 101 and 102, such as data transmission 120 and 123, may be used for various beneficial purposes, such as, for example, prosthesis maintenance, sound adjustment and/or bilateral synchronization, as described in more detail below.

Figure 2:
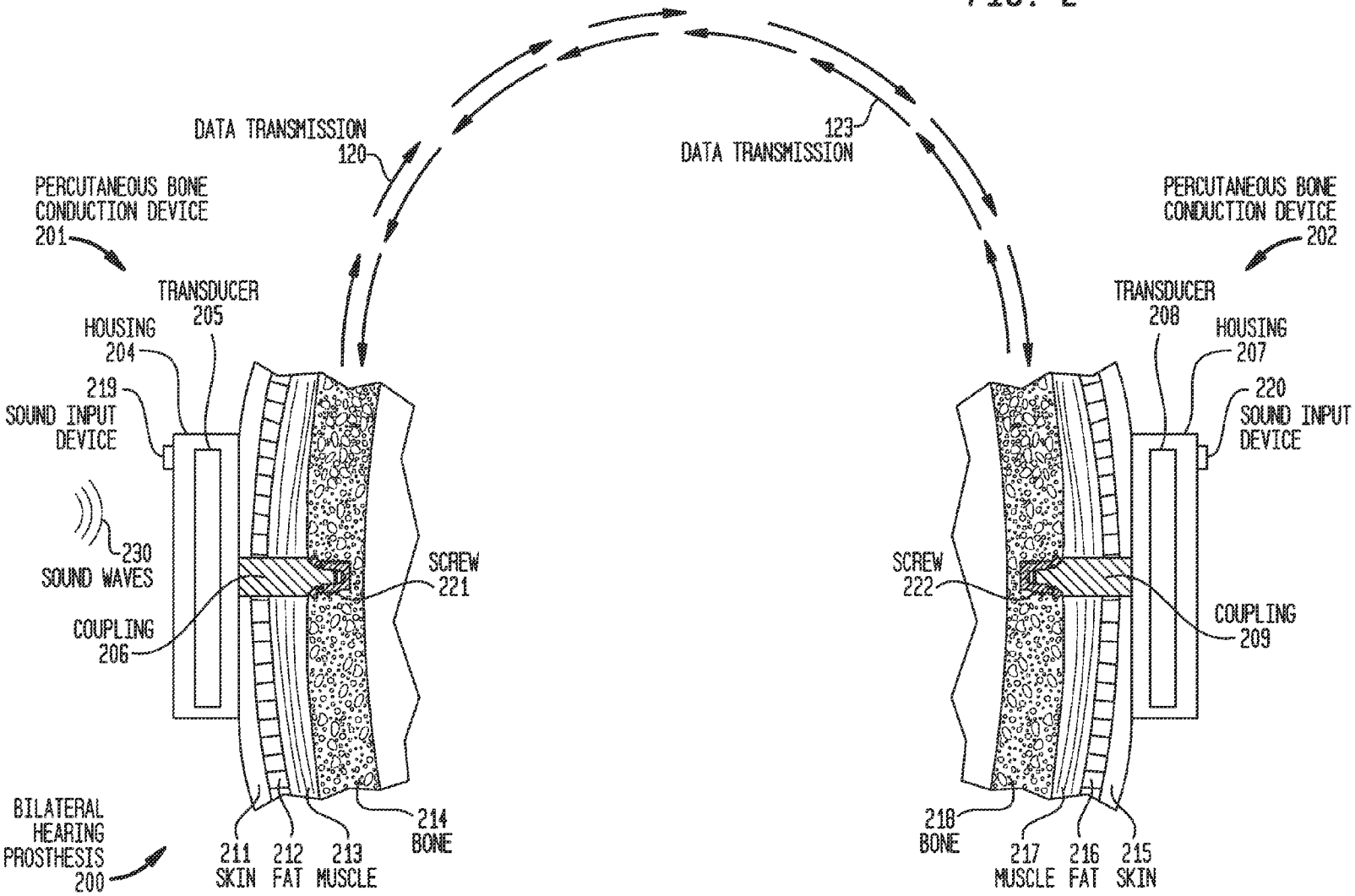
FIG. 2 illustrates a perspective view of a bilateral percutaneous bone conduction hearing system in which embodiments of the present technology may be implemented.

FIG. 2 illustrates a schematic view of a bilateral percutaneous bone conduction hearing system in which embodiments of the present technology may be implemented. The bilateral percutaneous bone conduction hearing system shown in FIG. 2 is an example embodiment of the bilateral bone conduction hearing system shown in FIG. 1. However, as noted, other types of bilateral bone conduction hearing systems may be utilized within the scope of the present technology. Percutaneous bone conduction device 201 provides vibrational stimulation to the recipient via implanted coupling 206 and screw 221. Device 201 is a passive percutaneous bone conduction device because vibrating transducer 205 is located external to the recipient's body. However, the present technology may be implemented as an active system, which would be similar to device 201 but with the active transducer located inside the recipient.

Device 201 includes housing 204. Vibrating transducer 205 is located inside housing 204. Sound input device 219 is shown in FIG. 2 as being located external to housing 204, and more specifically coupled to the outside of housing 204. However, sound input device 219 may be located inside housing 204. If located inside housing 204, sound input device 219 may be suspended or decoupled away from vibrating transducer 205, or may be directly or hard coupled to transducer 205. Vibrating transducer 205 is hard or rigidly attached to an anchor system, which includes coupling 206. More specifically, transducer 205 and coupling 206 are physically and firmly connected to each other so as to allow for the transmission of mechanical force between transducer 205 and coupling 206. A portion of coupling 206 is located inside housing 204 and a portion of coupling 206 is located outside of housing 204. However, coupling 206 may be located wholly outside of housing 204 and, for example, may be connected to the outside of housing 204.

Coupling 206 is connected to screw 221, as shown in FIG. 2. A portion of coupling 206 and screw 221 are implanted within the recipient, and more specifically in bone 214. Coupling 206 is inserted through skin 211, fat 212, muscle 213 to be fixed to the recipient's bone 214. Such a percutaneous abutment facilitates efficient transmission of mechanical force. It is appreciated that the use of bone conduction devices in FIG. 2 is exemplary, and other types of hearing prostheses may be used, such as a middle ear implant, hearing aid, cochlear implant, among other types, provided such devices are designed to process vibrations received via skull 103.

In an exemplary embodiment, vibrating transducer 205 converts electrical signals into vibrations. In operation, sound input element 219 converts ambient sound (which may be from the recipient's voice, or external sound) into electrical signals which are provided to a sound processor (not shown). After being processed, the electrical signals are provided to the transducer system including vibrating transducer 205. Vibrating transducer 206 generates vibrations in response to the control signals sent to it. Coupling 206 and screw 221 vibrate in response to vibration transmitted through the skin from transducer 205. Bone 214 then vibrates in response to vibrations of coupling 206 and screw 221.

Bone conduction device 201 may also be a transcutaneous bone conduction device. For example, instead of transducer 205 being attached to an anchor system that is directly implanted into the bone of the recipient, transducer 205 may be attached to a magnetic plate located outside of the recipient via a connecting shaft or post. The plate may be in the form of a permanent magnet and/or in another form that generates and/or is reactive to a magnetic field, or otherwise permits the establishment of magnetic attraction between the external device and an implantable component in the recipient's skull. As such, data and/or sound signals may be transferred to the skull of the recipient transcutaneously across the magnetic field created between the external and internal devices. In other embodiments, transcutaneous bone conduction device 201 is held in place via a soft band that encircles the recipient's head or other device that does not require surgery. In still other embodiments, bone conduction device 201 bypasses skin 215 entirely by delivering vibrations to skull 103 via a tooth.

A second percutaneous bone conduction device 202 is located on the contra lateral side of the recipient's head as percutaneous bone conduction device 201. Device 202 may be similar to device 201 or, as noted, any combination of other types of bilateral bone conduction hearing systems may be utilized within the scope of the present technology on either side of the recipient's head. FIG. 2, for example, illustrates bone conduction device 202 as a percutaneous bone conduction device similar to device 201. Percutaneous bone conduction device 202 provides vibrational stimulation to the recipient via implanted coupling 209 and screw 222.

Device 202 includes housing 207. Vibrating transducer 208 is located inside housing 207. Sound input device 220 is coupled to the outside of housing 207. Vibrating transducer 208 is hard or rigidly attached to coupling 209 to allow for the transmission of mechanical force between transducer 208 and coupling 209. Coupling 209 is connected to screw 222. A portion of coupling 209 and screw 222 are implanted within the recipient, and more specifically in bone 218. Coupling 209 is inserted through skin 215, fat 216, muscle 217 to be fixed to the recipient's bone 218.

Vibrating transducer 208 converts electrical signals into vibrations. In operation, sound input element 220 converts ambient sound into electrical signals which are provided to a sound processor (not shown). After being processed, the electrical signals are provided to the transducer system including vibrating transducer 208. Vibrating transducer 208 generates vibrations in response to the control signals sent to it. Coupling 209 and screw 222 vibrate in response to vibration transmitted through the skin from transducer 208. Bone 218 then vibrates in response to vibrations of coupling 209 and screw 222. It should be understood that percutaneous bone conduction device 202 may be a transcutaneous bone conduction device, similar to that described with respect to bone conduction device 201. Furthermore, device 202 may be replaced with a device that does not include a transducer at all. For example, the device 202 (or, for example, device 201) may also be replaced by an accelerometer, a microphone, or a different type of sensor that is able to receive mechanical signals. Such an embodiment of the present technology may be implemented, for example, in a sound bite system wherein, as noted, device 201 bypasses skin 215 entirely by delivering vibrations to skull 103 via a tooth. In such an embodiment, the transducer coupled to the tooth may send data regarding the device, such as for example a low battery, to a BTE or other second device, which may relay that information to the recipient.

Bone 214 and bone 218 are both part of the recipient's skull. As noted, when transducer 205 vibrates, bone 214 (the recipient's skull) also vibrates. Since bone 218 is also part of the recipient's skull, bone 218 will also vibrate, causing transducer 208 (which is attached to the anchor system implanted in bone 214) to vibrate as well. As such, sound received by sound input device 219 and other data may be transmitted from percutaneous bone conduction device 201 to transducer 208 on the contra lateral side of the recipient's head, and therefore to bone conduction device 202. Similarly, when transducer 208, which is on the contra lateral side of the recipient's head as transducer 205, vibrates, bone 218 (the recipient's skull) also vibrates. Since bone 208 is also part of the recipient's skull, bone 208 will also vibrate, causing transducer 205 (which is attached to the anchor system implanted in bone 218) to vibrate as well. As such, sound received by sound input device 220 and other data may be transmitted from percutaneous bone conduction device 202 to transducer 205 on the contra lateral side of the recipient's head, and therefore to bone conduction device 201. This data may be data representative of a received sound, data regarding a characteristic of bone conduction device 202, data from an external device coupled to bone conduction device 202 via a wire or wirelessly, or another source. It may be noted that skull transmission as discussed herein may also be used in conjunction with a wireless communication system, which will be described in more detail below.

When, for example, transducer 208 vibrates due to a mechanical force, which may represent a sound or other data signal, from the contra lateral side of the recipient's head, that force must be processed and understood as relevant information to be used by transducer 208 and bone conduction device 202. Similarly, when transducer 205 vibrates due to a mechanical force, which may represent a sound or other data signal, from the contra lateral side of the recipient's head, that force must be processed and understood as relevant information to be used properly by transducer 205 and bone conduction device 201. For example, a mechanical force received may represent data useful for synchronization, signal adjustment, or various other functions. On the other hand, received data may be noise or other unwanted feedback that is not useful. The receipt and processing of data received via bone conduction is described in more detail with respect to FIGS. 3, 4 and 5 below.

Figure 3A:
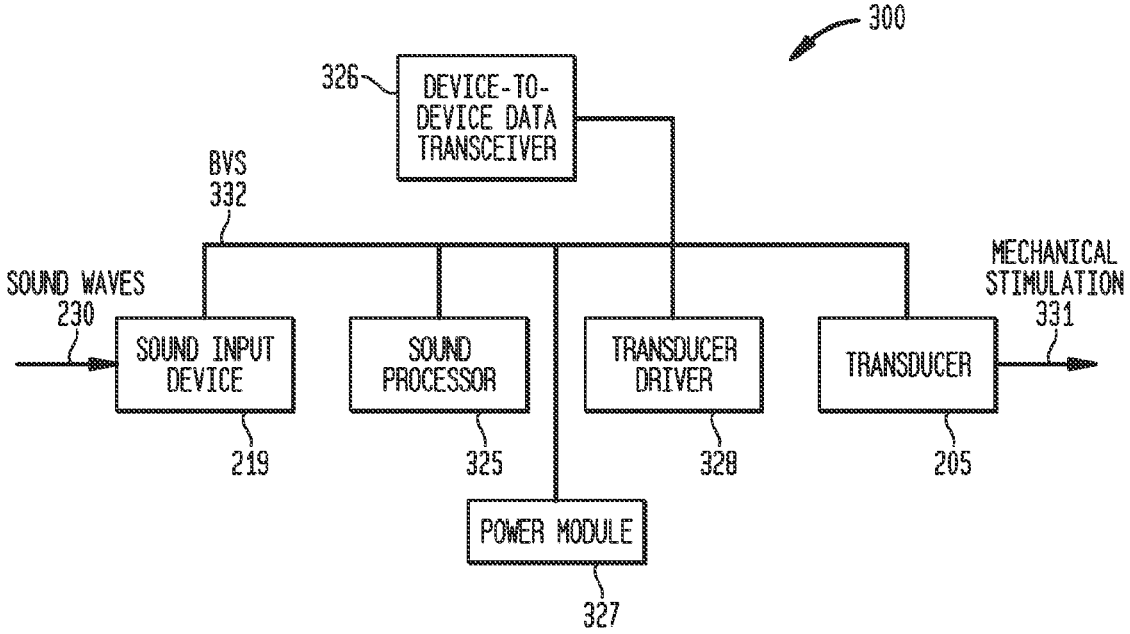
FIG. 3A illustrates a block diagram representing data transmission through a recipient's skull in which embodiments of the present technology may be implemented.

FIG. 3A illustrates a block diagram representing data transmission through a recipient's skull, for example using device 201 of FIG. 2, in which embodiments of the present technology may be implemented. Block diagram 300 shows a data bus 332 with various components of an exemplary bone conduction device, in accordance with embodiments of the present technology, connected to it. The block diagram illustrated in FIG. 3A may be implemented in, for example, circuitry placed within housing 204 (circuitry not shown in FIG. 2). For example, as shown in FIG. 3A, sound input device 219, sound processor 325, device-to-device data transceiver 326, power module 327, transducer driver 328 and transducer 205 may be connected to bus 332. Sound input device 219 receives sound waves 330 from the environment surrounding the recipient. Sound input device 219 may comprise a microphone, sensor or other acoustic-to-electric transducer that converts sound into electrical signals.

Sound processing block 325 may include the performance of various functions, including, for example, analog-to-digital (A/D) conversion, pre-processing, filtering and DSP/sound processing. In general, the sound processor may selectively amplify, filter and/or modify acoustic sound signal received from sound input device 219. Sound processor block 325 may comprise, for example, an analog-to-digital (A/D) conversion circuit that encodes analog audio signal at a specified sample rate, then further scales the encoded signal, prior to generating a digital signal representative of the received acoustic signal. Sound processing block 325 may also include pre-processing functions such as various types of signal conditioning, multi-channel compression, dynamic range expansion, noise reduction and/or amplitude scaling. Sound processing block 325 may also include any of various filtering and/or adaptive feedback functions to cancel out noise or other unwanted feedback. The sound processing block 325 may also include other components such as circuitry that can perform filtering and/or adaptive feedback functions to cancel out noise or other unwanted feedback.

Sound processor block 325 sends vibration commands to transducer 205 via a transducer driver 328. The transducer driver converts commands to an appropriate form and format suitable for the particular embodiment of the bone conduction vibration transducer. The transducer driver transmits drive signals to a vibration transducer, represented by transducer block 205. The transducer then transduces the sound information to physical movement in the form of vibrations. The transducer vibrates in a manner that the sound information is provided to the recipient's auditory nerve via bone conduction through the recipient's bone (e.g. the skull or a portion of the skull). The transducer driver represented by transducer driver block 328 may be housed in the same housing, for example housing 204 as shown in FIG. 2, as the sound processor and/or the transducer. The transducer driver and sound processor work together to provide electrical command signals to the transducer.

Power module block 327 represents a power module that provides electrical power to one or more components of bone conduction device 200. In FIG. 3A, power module block 327 has been shown to be connected to bus 332. Therefore, it should be appreciated that power module 327 may be used to supply power to any electrically powered circuits/components of the bone conduction devices in accordance with embodiments of the present technology, including sound input device 219, sound processor 325, transceiver 326 and/or transducer 205.

Figure 3B:
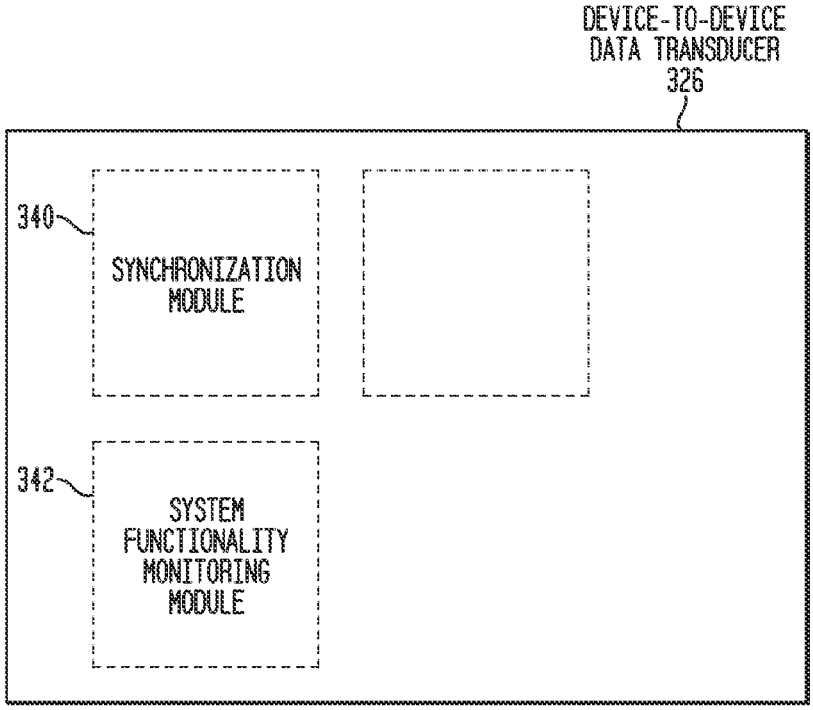
FIG. 3B illustrates a block diagram representing the device-to-device data transceiver as shown in FIG. 3A in which embodiments of the present technology may be implemented.

Also connected to bus 332 is device-to-device data transceiver block 326. Device-to-device data transceiver 326 comprises circuit components which receive transmitted data from other components of the bone conduction device it is a part of, such as sound processor 325 and transducer 205. Transceiver 326 also includes components which transmit data to other components of the bone conduction device. As shown, transceiver 326 is labeled as a data transceiver only. However, it should be appreciated that in certain embodiments, at least some of the same components of transceiver 326 may be used to receive and/or transmit power as well as receive and transmit data. A more detailed illustration of device-to-device data transceiver block 326 is shown in FIG. 3B, described in further detail below.

As shown in FIG. 3A, transducer 205 provides an output of mechanical stimulation 331 to the recipient. As shown in FIG. 2, transducer 205, which may be located in transducer block 205 if implemented as shown in FIG. 3A, is coupled to bone 214 so that when transducer 205 vibrates, bone 214 (the recipient's skull) also vibrates. As noted, vibrations of the recipient's skull may be used to transmit a mechanical signal representative of sound waves received by sound input device 219 to the recipient's cochlea on the same side of the recipient's auditory system as the vibrating transducer, for example cochlea 151. However, the same or similar vibrations of the recipient's skull by the transducer may also be used to transmit a mechanical signal to the recipient's contra lateral side and received by a hearing device on the contra lateral side. More specifically, mechanical signals sent to the contra lateral side may include sound signals representing sound waves received from sound input device 219, or the mechanical signals may represent other data used for various system maintenance and other procedures, including synchronization of the bilateral system's devices, diagnosis of system problems, decisions on which device to operate and at what level, among others. These functions may be monitored and implemented, for example, by device-to-device data transceiver 326. FIG. 3B illustrates a block diagram representing the device-to-device data transceiver as shown in FIG. 3A. FIG. 3B will be discussed in more detail below.

A benefit of transmission of data through a recipient's skull bone is that such transmission may be more reliable than pure wireless transmission requiring transmission through a different medium, such as air. However, a system in accordance with the present technology including data transmission through a skull may be combined with a wireless system with data transmission through the air. Both wireless solutions may be running at the same time, or one system may be turned off while the other transmits data from one device to the contra lateral device. The determination of whether both systems will run at the same time or not may be determined based on the present state or functionality of each system at the time of transmission, such as, for example, how much battery life each has, whether all components of each system are functional (e.g. broken microphone), and other factors. The determination may also be based on the location of the recipient. In some locations, such as on an airplane, wireless device communication through the air is not always permitted. In such locations, the recipient's devices implementing embodiments of the present technology continue to conduct wireless communication through the recipient's skull.

Another benefit of implementing the described embodiments of the present technology is the ability of the two systems to share responsibility for transmission of data, both to each other and to the recipient's cochlea via stimulation. For example, improved transfer of data between two hearing prostheses within a bilateral hearing prosthesis system may allow for one device to stimulate the recipient's cochlea on one side of the recipient's head, mechanically or otherwise, at a certain range of frequencies and for the second device to stimulate the recipient's other cochlea at a second set of frequencies. Furthermore, required calculations (which may, for example, take place in the sound/signal processors of the bilateral prosthesis) may be split up and performed in the two different devices within the bilateral prosthesis. For example, if the system uses multiple filters or feedback reduction algorithms for different types of noise/feedback, one device may perform a subset of the different filters/algorithms while the other device performs the rest of the filters/algorithms. As another example, one device may deliver audible (e.g. music) data while the other device delivers all other types of data. However, no matter what the breakdown of responsibility between multiple devices within a bilateral prosthesis, consistent and accurate communication is necessary between the devices. As described herein, transmission of data through the recipient's skull may allow for this type of communication.

Figure 4:
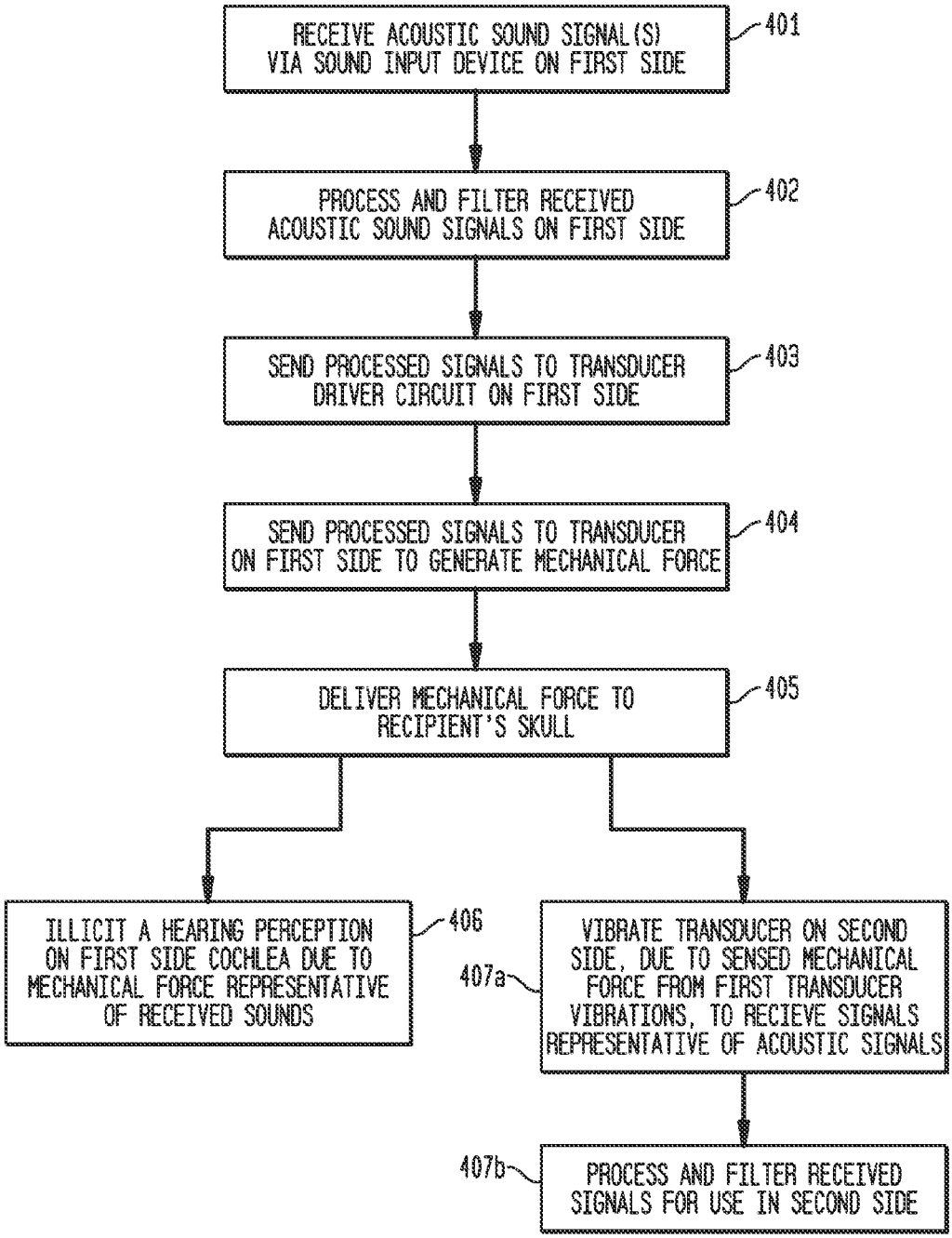
FIG. 4 illustrates a flow chart showing the transmission of data through a recipient's skull in which embodiments of the present technology may be implemented.

FIG. 4 illustrates a flow chart showing the transmission of data through a recipient's skull in which embodiments of the present technology may be implemented. More specifically, FIG. 4 shows the process of data transmission through the block diagram system from FIG. 3A, as described above. As noted in block 401, acoustic sound signals are received via a sound input device on the first side of a recipient's head (for example, in bone conduction device 201 as illustrated in FIG. 2). The sound signals received at the sound input device may include acoustic sound waves, including ambient sound and noise, as well as possible feedback from external or internal sources, such as from vibrations from the device's transducer. As noted in block 402, the inputted sound signals are processed and filtered before being sent to a transducer driver circuit, as noted in block 403. The transducer driver converts the signals to an appropriate form and format suitable for the transducer to understand. As noted in block 404, the transducer driver signals are sent to the transducer on the first side of the recipient's head. The transducer driver signals cause transducer to vibrate with a pulse that is representative of the processed sound waves received by the sound input device and deliver a mechanical force to the recipient's skull, at block 405.

The vibrations of the transducer cause the transmission of data through the skull of the recipient. As noted in block 406, the transducer vibrations illicit a hearing perception on the cochlea on the first side of the recipient's head due to the mechanical force caused by the vibrations. Furthermore, as noted in block 407*a*, the first side transducer vibrations also cause a transducer on the second side of the recipient's head (for example, in bone conduction device 202 as illustrated in FIG. 2) to vibrate. Note that the transducer on the second side (or the transducer on the first side) may also be replaced by or used in conjunction with an accelerometer, a microphone, or a different type of sensor that is able to receive mechanical signals. As noted in block 407*b*, the received mechanical signals are then processed (and filtered, if necessary) for use (synchronization, monitoring, comparison, etc.) on the second side of the recipient's head for, the hearing prosthesis on the second side of the recipient's head to, for example, reconfigure or recalibrate itself. Reconfiguration and recalibration operations may include any of the adjustment operations described herein.

Referring back to FIG. 3B, FIG. 3B illustrates a block diagram representing the device-to-device data transceiver as shown in FIG. 3A in which embodiments of the present technology may be implemented. Device-to-device data transceiver block 326 may perform a variety of different functions within the scope of the bone conduction device that it is a part of. For example, as shown in FIG. 3B, device-to-device data transceiver 326 may include synchronization module 340. Synchronization is necessary because hearing prostheses typically undertake complex data processing tasks including, for example, sound data processing, multiway data communications, power and peripheral systems management, user interfaces, and internal housekeeping such as, for example, energy management functions. The processing within these hearing systems, and specifically within bone conduction devices, introduces processing delays between the audio signal and the delivery of the corresponding mechanical stimulation. Each prosthesis 201, 202 as shown in FIG. 2 in bilateral system 200 is subject to differences in processing demands, and in response will have small differences in timing relative to each of the other prosthesis in system 200. Such differences tend to increase over time. As a consequence, the timing differences between the sound signals will not be preserved, and the loss of phase of vibration signal and temporal detail of delivered sound information can adversely affect a recipient's ability to spatially locate the source of incoming sounds and other attributes of the sounds that the recipient perceives.

A bilateral hearing prosthesis in accordance with the present technology can help to remedy this noted loss of phase. Referencing back to FIG. 2, for example, bone conduction device 201 may compare two different versions of sound waves 230 received by device 201. More specifically, device 201 may receive a first sound signal, representative of sound waves 230, at sound input device 219 and process that sound using sound processor 325. Device-to-device data transceiver module 326 is connected to sound processor 325 via bus 332, and therefore may also receive the processed signal. Device 201 may also receive a second sound signal, also representative of sound waves 230, which may be transmitted by bone conduction device 202 via vibrations of the recipient's skull. For example, sound input device 220 may receive a similar signal to the first sound signal received by sound input device 219, a second sound signal, which is then processed and sent to transducer 208. After transducer 208 vibrates in response to a received transducer driver signal (again, representative of the received signal at sound input device 220), bone 218 (the recipient's skull) vibrates with a pulse representative of the received sound signal, which transmits data 123 through the skull. Data 123 is also representative of the second sound signal. Since transducer 205 is also coupled to the recipient's skull via coupling 206 and screw 221, transducer 205 also vibrates in response to the vibrating skull and therefore receives data transmission 123.

To be useful to device 201, data 123 must be received and processed as information. Device-to-device data transceiver block 326 may receive data 123. Data transceiver block 326 may understand data 123 as a data signal by, for example, monitoring (along with, for example, sound processor block 325) the voltage gain across transducer 205. As transceiver 326 detects a change in voltage across the transducer, it reads the transducer as vibrating and, therefore, in the process of receiving a data transmission from the skull.

Having received information from a first sound signal from sound input device 219 via sound processor 325 and a second sound signal from device 202 via transducer 205, data transceiver 326 may compare the two signals. In other words, device 201 may use information received from device 202, namely information from the second sound signal representative of sound waves 230 from device 202 to synchronize device 201 with device 202. After transceiver block 326 compares the two received signals, the system may determine whether it needs to synchronize. If the signals are already synchronized, transceiver 326 may ignore data transmission 123 and send the first sound signal as received from sound processor 325 to transducer driver 328 to drive the transducer to vibrate (or send a signal to transducer driver 328 to indicate that driver 328 should drive transducer 205 to vibrate) based on the sound signal as received at sound input device 219. However, if the signals are unsynchronized, transceiver 326 may synchronize the signals before the system allows for transducer 205 to send a mechanical signal based on sound waves 230.

Bilateral hearing prosthesis 200 may synchronize based on characteristics or functional states other than phase or timing of stimulation signals. Therefore, data transmission 123 through the recipient's skull may include data other than sound signal data. For example, data transmission 123 may include volume and/or noise data from device 202 (such as, for example, noise from wind on one side of the recipient's head). Attributes such as volume and noise on one side of the recipient's bilateral prosthesis may be monitored by the contra lateral side using data transmission, as shown by system functionality monitoring module 342 in FIG. 3B. System functionality monitoring module 342 may be utilized in conjunction with synchronization module 340 to monitor and adjust one or more characteristics of the prosthesis system to maximize the system's effectiveness.

For example, once transceiver 326 receives such volume and/or noise data from device 202 (using the same or similar process as described above), device 201 may compare the signal-to-noise ratio (SNR) at device 202 due to noise received at sound input device 220 (and at other parts of device 202) with the SNR at device 201 due to noise received at sound input device 219 (and at other parts of device 201). If the SNR at device 201 is lower than at device 202, then transceiver 326 may lower the volume of stimulation delivered to the cochlea via device 201 so that the effect on the recipient of the greater noise ratio at device 201 is minimized. However, if the SNR at device 201 is higher than at device 202, then transceiver 326 may raise the volume of stimulation delivered to the cochlea via device 201 so that the effect on the recipient of the greater noise ratio at device 202 is minimized. Of course, device 202 may perform the same analysis using its transceiver and stimulation system and its two received signals, a first signal received directly from sound input device 220 and a second signal received from device 201 via vibration of the recipient's skull and transducer 208.

As noted, volume and noise data are examples of the types of data that may be transmitted as data transmission 123 or 120 from one hearing prosthesis to a contra lateral hearing prosthesis. It would be understood that various other types of data may be transmitted through the recipient's skull for various purposes. For example, one device within a bilateral prosthesis may have a lower amount of power than the device on the opposite side of the recipient's head. In such a situation, the transmission of data to represent that power level allows the devices to determine if one device should be utilized less than the other device to preserve power in that device. For example, device-to-device data transceiver 326 may determine which device in the bilateral prosthesis should stimulate the recipient's cochlea or synchronize the system based on a comparison of the power level in the power module on one side of the prosthesis (for example, power module 327) with the power module on the contra lateral side of the recipient.

Data transmitted through the recipient's skull, such as data transmission 123 or 120, as shown in FIGS. 1 and 2, may be transmitted in a variety of different ways. For example, data may be transmitted as a series of bytes, characters or bits alone, or data may be embedded as data packets, either transmitted on their own or, for example, embedded within a sound signal. However, no matter how the data (audio signals or other data) is transmitted, the receiving side of the bilateral prosthesis must have some indication that the signal being received is a signal intended for its receipt and use, such as data transmission 123 or 120, as opposed to the other signals that may be picked up by the skull and transmitted to the receiving side such as noise. There are a variety of ways in which the two devices within the bilateral hearing prosthesis may communicate to identify a desired signal. For example, the bilateral system may use the comparison technique described above. More specifically, as noted, having received, for example, information from a first sound signal from sound input device 219 via sound processor 325 and a second sound signal from device 202 via transducer 205, data transceiver 326 may compare the two signals. Transceiver 326 may use its comparison of the first and second sound signals to determine if the signals are similar enough to indicate that the signal it received from the contra lateral side represents the sound waves it received at its sound input device, for example input device 219. If the signals are similar within a certain predetermined amount of error, transceiver 326 may then process the received signal for use. If the signals are not similar enough, it may ignore or discard the signal received from the contra lateral side.

As noted, signals other than audio signals may be sent by the contra lateral side of the recipient's head as intended for receipt and use. For example, signals representing volume, available power, or other signals representing functionality of the contra lateral device may be transmitted. Therefore, other recognition systems may be used. For example, the transmitting device may accompany the intended data signal being transmitted with a predetermined (in type, length, etc.) data packet that the contra lateral device understands as an indication of transmission of an intended data signal. When a transceiver component recognizes the coded data packet, it knows to receive and process the following data packet or set of data packets as an intended signal. A second coded data packet may also be sent directly after the intended data signal to indicate termination of the intended signal.

The usefulness of a data signal transmission may also be determined by a bilateral prosthesis according to the frequency or other fitting parameters at which a transmission is sent through the recipient's skull. For example, the system may utilize the fitting parameters of the recipient's prostheses, as determined and set by a doctor when fitting the recipient. Today, for example, most cochlear implants require at least two stimulation level parameters to be set for each stimulating electrode within the recipient's cochlea. These values are referred to as the Threshold level (commonly referred to as the "THR" or "T-level;" "threshold level" herein) and the Maximum Comfortable Loudness level (commonly referred to as the Most Comfortable Loudness level, "MCL," "M-level," or "C;" simply "comfort level" herein). Threshold levels are comparable to acoustic threshold levels; comfort levels indicate the level at which a sound is loud but comfortable. For example, data transmission 123 or 120 may be transmitted at a level below the recipient's threshold level such that the recipient cannot hear the transmitted signal. The receiving device of the bilateral prosthesis may understand that signals sent at below the threshold level (or at a specific, predetermined level) is necessarily intended to be received and used by the receiving device. A similar result may be achieved if data is sent through the skull in small bursts, or in other words the length of each data transmission is small enough so that the short transmissions will integrate into the recipient's hearing and recipient will not hear the transmissions over time. Yet another similar result may be achieved if a particular frequency and amplitude are selected for data transmission so that the data signal is masked by other audio signals presented to the user. The hearing prosthesis may also use a combination of the above-described systems to identify wanted/intended signals.

Figure 5:
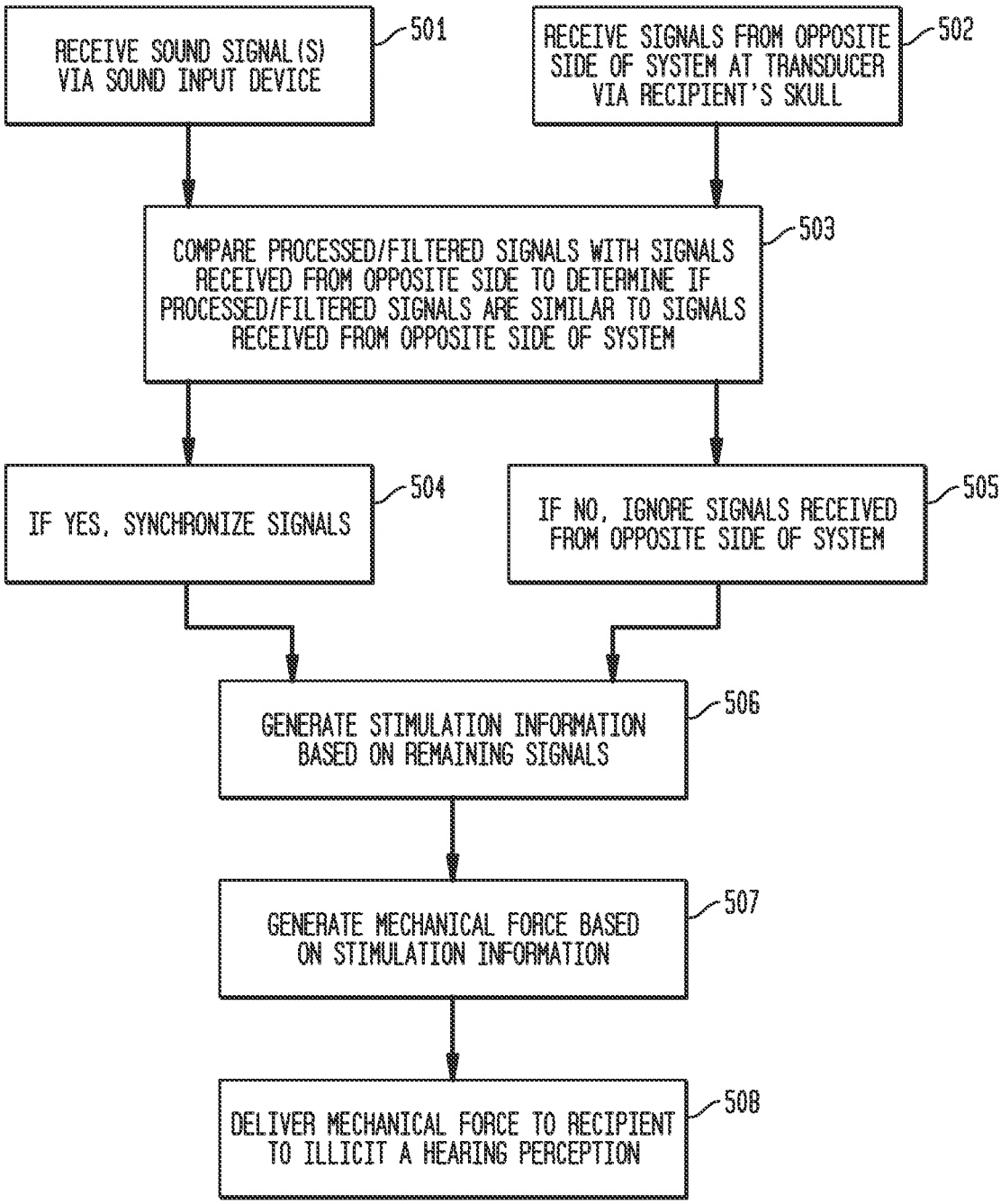
FIG. 5 illustrates a detailed flow chart showing the transmission of data through a recipient's skull in which embodiments of the present technology may be implemented.

FIG. 5 illustrates a detailed flow chart showing the transmission of data through a recipient's skull in which embodiments of the present technology may be implemented. More specifically, FIG. 5 illustrates the process of synchronizing the hearing prosthesis system using data signals from both sides of the recipient's prosthesis, as described above. As noted in block 501, acoustic sound signals are received via a sound input device on the first side of a recipient's head (for example, in bone conduction device 201 as illustrated in FIG. 2). As noted in block 502, and as described in detail above with respect to FIG. 3A, data signals (which may represent a sound signal or other data) from the contra lateral side of the recipient's head (for example, from bone conduction device 202 as illustrated in FIG. 2) may also be received. The data signals from the contra lateral side may be received at the transducer or other sensor on the recipient's first side via transmission through the recipient's skull. As noted in block 503, the two signals may be compared to determine if the signals are similar, or may otherwise use the signals to determine if the system needs to be synchronized. If so, then the system may synchronize the signals, as noted in block 504. If not, then the system may otherwise ignore the contra lateral signal(s), as noted in block 505, and generate stimulation information to be sent to the transducer assembly, as noted in block 506. The system then generates a mechanical force based on the remaining signal, using, for example, a transducer, as noted in block 507, and that mechanical force is delivered to the recipient's skull, as noted in block 508.

Transmitting data as vibrations traveling through a recipient's skull bone within a bilateral prosthesis system has many benefits, in addition to those described above. For example, embodiments in accordance with the present technology may avoid the head shadow effect. Instead, as described above, the present technology allows the recipient to selectively listen to the side with the better signal-to-noise ratio, generally the side closer to the source of the sound. Furthermore, the embodiments described in accordance with the present technology may allow the bilateral prosthesis to save power and improve latency (i.e. higher propagation of speed) of transmission when compared to similar wireless bilateral prostheses. Additionally, bilateral prostheses implementing embodiments of the present technology advantageously may not include components which provide wireless transmission capabilities. Exclusion of such wireless data transmission components from the bilateral prosthesis can result in a simpler construction and/or reduced physical size of the external components of the bilateral prosthesis.

The technology described and claimed herein is not to be limited in scope by the specific preferred embodiments herein disclosed, since these embodiments are intended as illustrations, and not limitations, of several aspects of the technology. Any equivalent embodiments are intended to be within the scope of this technology. Indeed, various modifications of the technology in addition to those shown and described herein will become apparent to those skilled in the art from the foregoing description. Such modifications are also intended to fall within the scope of the appended claims.

What is claimed is:

1. A bilateral system, comprising:

a first mechanical stimulator device configured to transmit first data through first vibrations of a skull of a recipient; and a sensor device vibrationally coupled to the skull configured to receive the first transmitted data through the first vibrations of the skull bilaterally transmitted from the first mechanical stimulator device to the sensor device.

2. The bilateral system of claim 1, wherein the first mechanical stimulator device comprises a first sound input device and a first transducer.

3. The bilateral system of claim 2, wherein the first sound input device is configured to receive an acoustic sound and the first transducer is configured to deliver to the skull of the recipient second vibrations representative of the received acoustic sound.

4. The bilateral system of claim 3, wherein the sensor device comprises a second mechanical stimulator device including a second sound input device and a second transducer.

5. The bilateral system of claim 4, wherein the sensor device is configured to receive the first and second vibrations.

6. The bilateral system of claim 5, wherein the sensor device further comprises a transceiver configured to monitor the voltage across the second transducer.

7. The bilateral system of claim 6, wherein the transceiver is configured to detect a change in voltage across the second transducer to indicate that the first vibrations have been received.

8. The bilateral system of claim 6, wherein the transceiver is configured to compare the first data with a second data, the second data being associated with the second mechanical stimulator device.

9. The bilateral system of claim 8, wherein the second mechanical stimulator device is configured to synchronize the first mechanical stimulator device and the second mechanical stimulator device.

10. The bilateral system of claim 4, further comprising a synchronization module configured to synchronize the first mechanical stimulator device with the second mechanical stimulator device.

11. The bilateral system of claim 4, wherein the first transducer is configured to transmit the first data, through first vibrations of a skull of a recipient, at a first frequency and wherein the second transducer is configured to transmit a second data, through second vibrations of the skull of the recipient, at a second frequency.

12. The bilateral system of claim 11, wherein the first data and the second data are transmitted through the skull of the recipient at substantially the same time such that first vibrations and second vibrations of the skull occur at substantially the same time.

13. The bilateral system of claim 12, wherein the second mechanical stimulator device is configured to adjust the first data based on the recorded changes.

14. The bilateral system of claim 1, wherein the first mechanical stimulator device comprises a first hearing prosthesis that is configured to transmit the first data through mechanical stimulation of the skull and wherein the sensor device comprises a second hearing prosthesis that is configured to receive the first data through mechanical stimulation of the skull.

15. The bilateral system of claim 1, wherein the first data comprises data representative of one or more of types of data selected from the group comprising: synchronization, volume, power level, noise, latency, phase, and component functionality.

16. The bilateral system of claim 1, wherein the first mechanical stimulator device is part of a hearing prosthesis that is configured to transmit the first data through mechanical stimulation of the skull and wherein the sensor device is also part of the hearing prosthesis that is configured to receive the first data through mechanical stimulation of the skull.

17. The bilateral system of claim 1, wherein the sensor is not a sound input device.

18. The bilateral system of claim 1, wherein the sensor is configured to be at least one of hard or rigidly attached to a component having at least a portion thereof located beneath skin of the recipient and in vibrational communication with the skull.

19. A method of transmitting data comprising:

generating with a first device a vibration to be applied to a skull of a recipient, wherein the first device is vibrationally coupled to the skull;

receiving with a second device the vibration, whereby the data is transmitted through the skull via the vibration, wherein the vibration is bilaterally transmitted from the first device to the second device.

20. The method of claim 19, wherein one or both of the first and second devices comprise a hearing prosthesis.

21. The method of claim 19, further comprising synchronizing the first device with the second device based at least partially on the data.

22. The method of claim 21, wherein synchronizing further comprises synchronizing the phase of the first device with the phase of the second device.

23. The method of claim 19, wherein the data comprises data representative of one or more of types of data selected from the group comprising: synchronization, volume, power level, noise, latency, phase, and component functionality.

24. The method of claim 19, wherein the vibration is based on a driver signal, the method further comprising:

comparing the data to a second data to determine a characteristic of the hearing prosthesis, and adjusting the driver signal based on the determined characteristic.

25. The method of claim 24, wherein the driver signal is a transducer driver signal to cause the transducer to vibrate with a pulse that is representative of the data.

26. The method of claim 19, wherein generating the vibration further comprises stimulating the recipient's skull at a stimulation level parameter below a threshold level of the recipient.

27. The method of claim 19, further comprising transmitting a notification signal directly before generating the vibration to indicate the transmitting of the data.

28. The method of claim 27, further comprising transmitting a notification signal directly after transmitting the data to indicate the ending of transmission of the data.

29. The method of claim 19, wherein the second device is a sensor.

30. The method of claim 19, wherein before the vibrations are received by the second device, the vibrations travel through the skull and then into an artificial structure mechanically coupled to the second device.

31. The method of claim 19, wherein a vibration path of the vibrations after the skull and including the second device is made up of an entirely artificial structure.

* * * * *